US008985039B2

(12) United States Patent
Price et al.

(10) Patent No.: US 8,985,039 B2
(45) Date of Patent: Mar. 24, 2015

(54) SYSTEM FOR ATTACHMENT OF HANDLES TO MATTRESS BORDERS

(71) Applicant: Atlanta Attachment Company, Lawrenceville, GA (US)

(72) Inventors: Elvin C. Price, Dacula, GA (US); John S. Chamlee, Lawrenceville, GA (US); Preston B. Dasher, Lawrenceville, GA (US); Van H. Nguyen, Lawrenceville, GA (US)

(73) Assignee: Atlanta Attachment Co., Lawrenceville, GA (US)

( * ) Notice: Subject to any disclaimer, the term of this patent is extended or adjusted under 35 U.S.C. 154(b) by 141 days.

(21) Appl. No.: 13/835,297

(22) Filed: Mar. 15, 2013

(65) Prior Publication Data

US 2014/0261124 A1 Sep. 18, 2014

(51) Int. Cl.

| | |
|---|---|
| ***D05B 33/00*** | (2006.01) |
| ***D05B 11/00*** | (2006.01) |
| ***D05B 35/06*** | (2006.01) |

(52) U.S. Cl.

CPC ..... *D05B 11/005* (2013.01); *D05B 35/06* (2013.01)

USPC ..... 112/475.08

(58) Field of Classification Search

CPC ..... D05B 33/00

USPC ..... 112/475.08, 2.1, 114, 152, 153, 470.09, 112/470.14, 470.16, 470.33, 475.07

See application file for complete search history.

(56) References Cited

U.S. PATENT DOCUMENTS

| | | | | |
|---|---|---|---|---|
| 1,731,530 | A * | 10/1929 | Goldeen et al. | 5/703 |
| 3,799,082 | A * | 3/1974 | Redman | 112/2.1 |
| 4,114,544 | A | 9/1978 | Miyachi et al. | |
| 4,803,935 | A | 2/1989 | Off | |
| 5,520,129 | A | 5/1996 | Porter et al. | |
| 5,588,384 | A * | 12/1996 | Miyachi et al. | 112/475.06 |
| 5,738,029 | A | 4/1998 | Porter et al. | |
| 5,881,656 | A | 3/1999 | Grant | |
| 5,983,814 | A | 11/1999 | Block | |
| 6,202,579 | B1 | 3/2001 | Olewicz et al. | |
| 6,209,468 | B1 | 4/2001 | Marcangelo et al. | |
| 6,397,768 | B1 | 6/2002 | Dasher et al. | |
| 6,684,461 | B1 | 2/2004 | Barnhardt | |
| 6,983,706 | B2 | 1/2006 | Marcangelo | |
| 7,100,525 | B1 | 9/2006 | Price et al. | |
| 7,100,526 | B1 | 9/2006 | Olewicz et al. | |
| 7,984,681 | B1 | 7/2011 | Oxley et al. | |
| D659,459 | S | 5/2012 | Jung et al. | |
| D670,126 | S | 11/2012 | Price | |

FOREIGN PATENT DOCUMENTS

| | | |
|---|---|---|
| NL | C1025518 | 2/2004 |

* cited by examiner

*Primary Examiner* — Tejash Patel

(74) *Attorney, Agent, or Firm* — Womble Carlyle Sandridge & Rice LLP

(57) ABSTRACT

A system for attaching handles to a workpiece, such as for attaching handles to a border material for a mattress. The system includes a pair of sewing heads movably mounted along a sewing area. The sewing heads can be moved from a first position for sewing the handles to the border in a first orientation, such as a horizontal orientation extending along the length of the border, to a second position for sewing the handles to the border in a different orientation, such as a vertical orientation extending across the width or height of the border.

15 Claims, 7 Drawing Sheets

SYSTEM FOR ATTACHMENT OF HANDLES TO MATTRESS BORDERS

FIELD OF THE INVENTION

The present invention generally relates to systems for the manufacture of components for mattresses or other bedding articles, and in particular to a system for attaching handles to a border material for a mattress or other article of bedding wherein the handles can be attached in varying orientations.

BACKGROUND OF THE INVENTION

Mattresses and other articles of bedding traditionally have been provided with handles attached along a side panel or border thereof. Such handles previously have been made from cords or rope materials, the ends of which are extended through grommets attached to the border material and stapled or otherwise secured within the mattress. In addition, mattress handles also have been made from strips of fabric that are folded and their ends sewn to the borders between upper and lower edges thereof. In the past, handle attachment procedures generally have been somewhat labor intensive, requiring an operator to secure grommets into the borders and thereafter insert and secure the ends of the handles through such grommets, and/or by requiring the operator to physically fold and sew the handles in desired positions along the borders. More recently, automated systems have been developed for automatically feeding a handle material from a roll, and thereafter cutting and sewing the handles onto a length of border material, substantially reducing the amount of labor required for attachment of the handles to their mattress borders.

In addition to changes in the way mattresses and other articles of bedding are made, consumer tastes or preferences regarding mattresses likewise have changed, leading to an increased consumer demand for more aesthetic and functional features on mattresses and other bedding articles. For example, higher end, more expensive mattresses having pillow tops, individual pocketed coil springs and aesthetic patterned designs sewn or applied along the borders and mattress tops have become much more desirable to consumers. The increased demand for customized patterns and/or aesthetic features has also extended to more functional features such as the handles for such mattresses. For example, some manufacturers are using custom embroidered handles that are designed to match the pattern of the border to which they are attached, and which consequently typically require individual placement of the handles on the borders at locations whereby the pattern of the handle aligns or matches with the pattern of the border. This also can include the use of vertical handles that are attached in a widthwise direction along the borders. Automated handle attachment systems are not, however, generally designed to accommodate varying attachments of handles to their borders, such as mounting the handles in different orientations other than a conventional horizontal arrangement, or otherwise positioned along the mattress border so as to permit formation of additional aesthetic or customized features along the border as well.

Accordingly, it can be seen that a need exists for a system for attachment of handles to lengths of border materials for mattresses or other articles of bedding that addresses the foregoing and other related and unrelated problems in the art.

SUMMARY OF THE INVENTION

Briefly described, the present invention generally relates to a system for attaching handles to a length of material such as for forming a border for mattresses or other articles of bedding. The system of the present invention is adapted to enable accurate, consistent location and attachment of handles to their borders with the handles being selectively placed or positioned in different orientations. For example, the handles can be attached in a generally horizontal orientation extending substantially longitudinally along the length of the border to which they are attached, or can be oriented in a substantially vertical orientation, extending across the width or height of the border to which they are attached.

The system for attaching handles generally will include a frame or cabinet having a work surface supporting the operative elements thereof. A system control is provided, including an operator interface for enabling input of various operating parameters, such as sewing patterns and other programmed information for control of the system for attaching handles. A first or upstream adjustable material guide generally can be mounted along an upstream edge or portion of the work surface, with one or more adjustable guide rails or plates mounted thereon and defining a guide passage through which the length of border material will be fed along a path of travel into and through a sewing area. A second or downstream adjustable material guide also can be mounted along a downstream edge of the frame or cabinet, and can include movable guide rails or plates for receiving, supporting and feeding the border material with the handles attached thereto to a roll or other collection device.

First and second sewing heads generally are mounted along opposite sides of the sewing area. Each sewing head can be mounted on a movable carriage so as to enable one or both of the sewing heads to be moved with respect to the sewing area as needed for sewing different size or configuration handles, and/or for sewing the handles in different orientations with respect to the longitudinal length or axis of the border. The first and second sewing heads further can be moved independently and in different directions with respect to the sewing area; for example, the first sewing head can be moved laterally with respect to the sewing area, while the second sewing head can be moved longitudinally with respect to the sewing area. As a result, the sewing heads can be moved between a first position in which the sewing heads are positioned in a generally longitudinally spaced or staggered relationship or alignment along the sewing area, with the sewing needle of the second sewing head located downstream from the sewing needle of the first sewing head, and a second position in which the first and second sewing heads are located in a generally laterally spaced or unstaggered, substantially aligned or opposite facing relationship, with the sewing needles of both the first and second sewing heads being arranged laterally, on opposite sides of the sewing area. In their first position, the sewing heads can operate to attach the handles to the border material in a generally horizontally extending direction with respect to the longitudinal axis or length of the border material. In their second position, the sewing heads can operate to attach the handles to the border materials in a generally vertically extending orientation with respect to the longitudinal axis or length of the border material. Other positions of the sewing heads are also possible for attaching various handle configurations and orientations.

Each of the sewing heads also generally will include at least one sewing needle and a clamping mechanism operable to engage the handle and border material. Each clamping mechanism can include a first or primary clamp adapted to engage and hold the border material against a movable support or clamp plate, and a secondary clamp, which can be linked to or comprise the presser foot of its associated sewing head, for engaging and holding the handle against the border material for sewing. Each of the clamping mechanisms further can be mounted on movable clamp supports, such that the clamping mechanisms, when engaged with a handle and the border material, will move the handle and border material beneath the sewing needles of the sewing heads as the needles are reciprocated for attachment of the handles to their border materials. Each clamp mechanism also can include an edge guide, selected from one of a series of varying combination edge guides, mounted therealong by a series of releasable connectors, for guiding/locating one or more edges of the handles in a desired position for sewing to the border material.

Various features, advantages and aspects of the present invention further may be set forth or apparent upon consideration of the following detailed description, when taken in conjunction with the accompanying drawings. Moreover, it will be understood that the accompanying drawings, which are included to provide a further understanding of the present disclosure, are incorporated in and constitute a part of this specification, illustrate various aspects, advantages and benefits of the present disclosure, and together with the detailed description, serve to explain the principles of the present disclosure. In addition, those schooled in the art will understand that, according to common practice, various features of the drawings, as discussed below, are not necessarily drawn to scale, and that dimensions of various features and elements of the drawings may be expanded or reduced to more clearly illustrate the embodiments of the present disclosure.

DETAILED DESCRIPTION OF THE INVENTION

Figure 1:
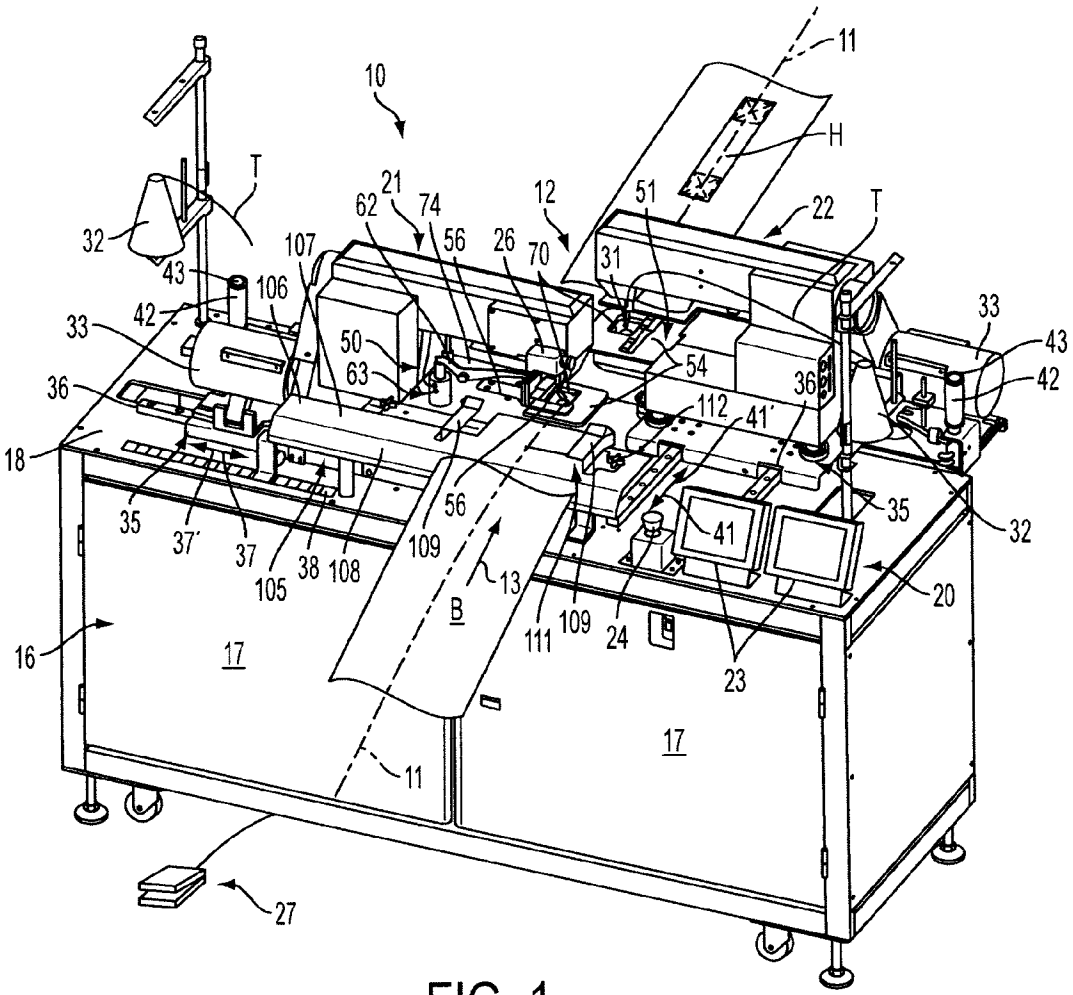
FIG. 1 is a perspective illustration of the system for attaching handles to a border according to one embodiment of the present invention.
Figure 2:
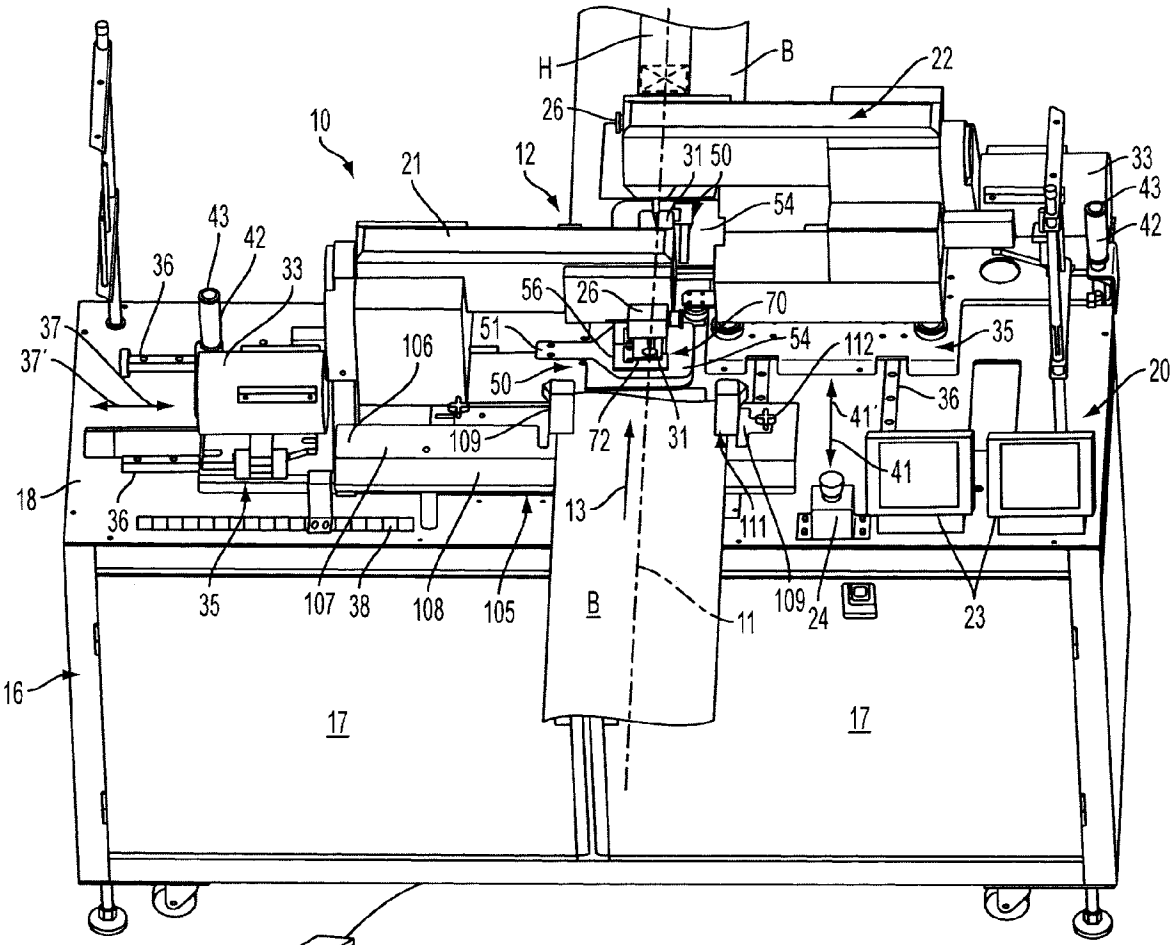
FIG. 2 is a front view of the system of FIG. 1 for attaching handles to a border.
Figure 3:
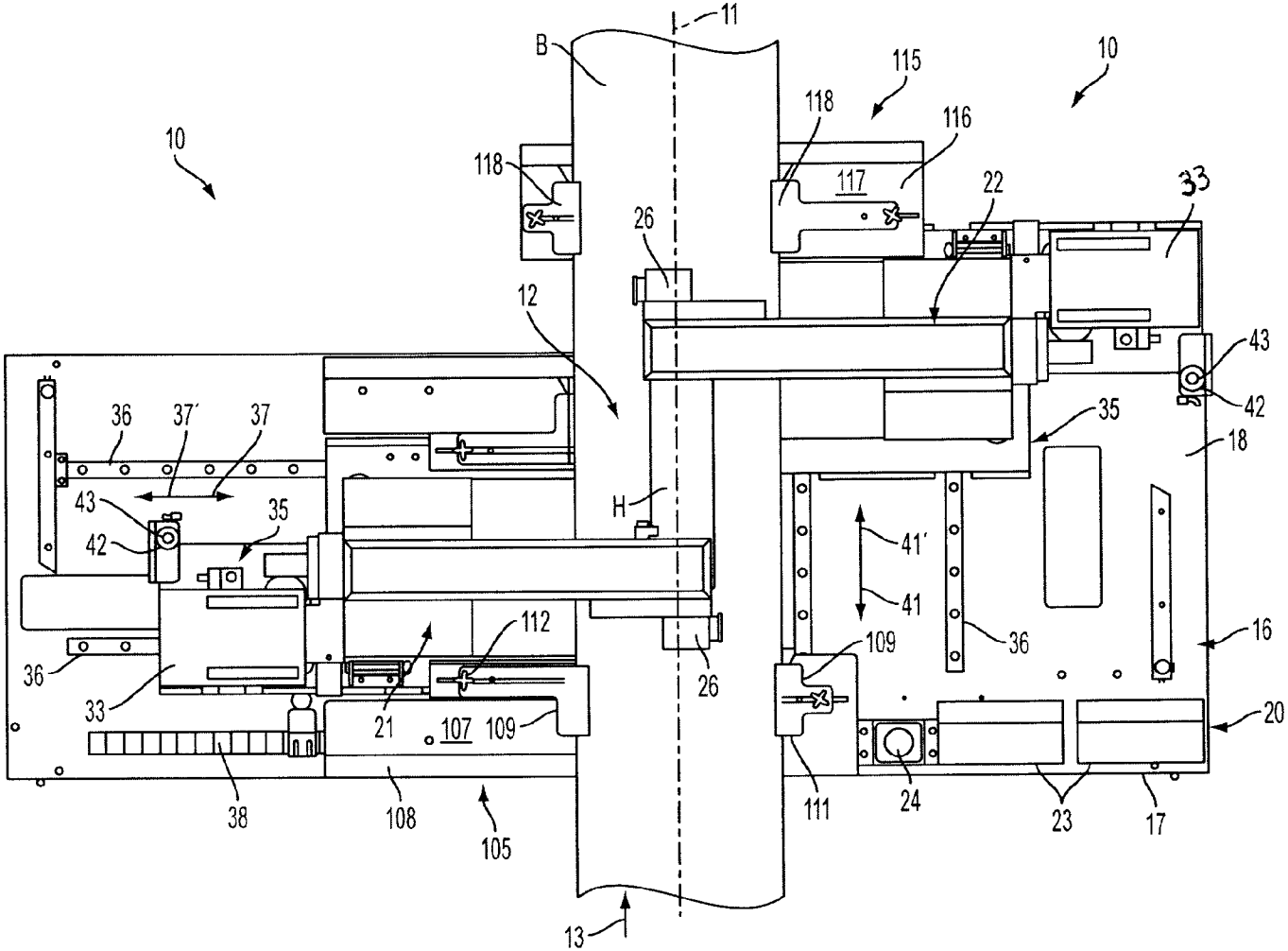
FIG. 3 is a plan view of the system of FIGS. 1-2 for attaching handles to a border.

Referring now to the drawings in which like numerals indicate like parts through the several views, FIGS. 1-3 generally illustrate one example embodiment of a system 10 for attachment of handles H to a border B such as for a mattress or other article bedding, or for attachment or joining of other, similar textile articles. The present system further is adapted to enable the attachment of handles to border materials of varying widths or heights, and with the handles having a wide variety of different sizes and/or configurations, as well as accommodating the orientation of the handles in different, varying orientations with respect to a longitudinal axis 11 of the border B, as indicated in FIGS. 3-4B. For example, the system 10 enables the attachment of the handles H in a substantially horizontal orientation extending generally lengthwise along the border B, including being attached or applied in a direction extending essentially parallel to the longitudinal axis 11 of the border. Alternatively, the handles can be reorientated in other, different orientations, including being arranged in a substantially vertical orientation extending substantially across the width or height of the border B in a direction generally perpendicular to the longitudinal axis of the border.

The border materials B generally can be fed as a length of a fabric textile border material, either from a supply roll (not shown) or as a precut length of border material, and generally will be fed through the system 10 and into a sewing area 12 along a path of travel 13, with the border B generally oriented in a lengthwise direction extending along its longitudinal axis 11, as illustrated in FIG. 3. The handles H similarly can be formed from a fabric or textile material, including being formed from the same or substantially the same material as the borders. Each handle also generally can be pre-formed, including having a cooperative pattern or design that matches or substantially matches the border to which it is applied.

As illustrated in FIGS. 1-3, the system 10 generally includes a frame 16, here shown as a cabinet or enclosure having door 17 and substantially flat work surface 18 that supports the various operative elements of the system 10 for attaching the handles to the borders. A system control 20 generally is provided for controlling operation of the operative elements of the system 10, including first and second sewing heads 21 and 22 and for monitoring the positioning or alignment of the handles and border and the first and second sewing heads 21 and 22 for attaching the handles to the border in differing orientations. The system control generally will include a processor or computer, typically housed within the frame or in cabinet 16, and at least one user interface such as touch screens 23 as shown in FIGS. 1 and 2. The touch screens enable the input of operational or programming information into the system control, and can provide display of the production or data of the system 10. Emergency stop controls 24 and 26 also can be provided along the front of the frame or cabinet 16, and adjacent each of the first and second sewing heads 21 and 22, as indicated in FIGS. 2 and 3. As further illustrated in FIGS. 1 and 2, the system control 20 also can include a foot pedal 27, which can be placed in a position in front of the frame or cabinet 16. The operator can engage the foot pedal once a handle has been placed in a sewing position along the border to initiate a sewing operation to attach the handle to the border.

As generally illustrated in FIGS. 1-4 B, each of the sewing heads 21 and 22 generally can include a conventional sewing machine having at least one sewing needle 31 that is reciprocated into out of the handle and border during a sewing operation to sew or otherwise attach the handles to their borders. Threads T (FIG. 1) can be fed from thread supplies 32 to each of the needles for forming lines of stitches in the handle for attaching the handles to their borders. Each sewing head further generally will include a drive motor 33 as shown in FIGS. 1-3. In addition, the system control can be programmed to apply such lines of stitching in a programmed pattern.

As further illustrated in FIGS. 1-3, each of the sewing heads 21 and 22 generally will be mounted upon a movable carriage 35 that is slideable or moveable along a series of guide tracks 36 for adjusting the position or location of the first and second sewing heads 21 and 22 with respect to the sewing area 13. The sewing heads thus can be moved between a first position in which the sewing heads are positioned in a generally longitudinally spaced or staggered relationship or alignment along the sewing area, with the sewing needle of the second sewing head located downstream from the sewing needle of the first sewing head, and a second position in which the first and second sewing heads are located in a generally laterally spaced or unstaggered, substantially aligned or opposite facing relationship, with the sewing needles of both the first and second sewing heads being arranged laterally, on opposite sides of the sewing area. In their first position, the sewing heads can operate to attach the handles to the border in a horizontal orientation extending along the length of the border in the direction of the longitudinal axis or length of the border. In their second position, the sewing heads can operate to attach the handles to the border materials in a vertical orientation extending width-wise or generally perpendicular with respect to the longitudinal axis or length of the border material. Other positions of the sewing heads are also possible for attaching various handle configurations and orientations.

Each of the sewing heads generally can be independently movable, and as illustrated in FIGS. 1-3, in at least one embodiment can be movable in different directions. For example, the carriage 35 of the left-hand or first sewing head 21 can be movable in a lateral direction in the direction of arrows 37 and 37', so as to enable movement of the sewing head 21 and its drive motor 33 laterally with respect to the sewing area 12 and longitudinal axis 11 of the border B. A rule or scale 38 further can be positioned adjacent the carriage 35 of the sewing head 21 to provide a visual reference for positioning the sewing head 21 in a desired lateral position with respect to the sewing area and border. In similar fashion, the carriage 35 of the second or right-hand sewing head 22 can be movable in a longitudinal direction, as indicated by arrows 41 and 41' in FIG. 3 in order to move the sewing head 22 in a direction substantially parallel to the longitudinal axis 11 or length of the border B to adjust the longitudinal position of the second sewing head 22 with respect to the sewing area 11. Although not shown, a rule or scale similarly can be provided adjacent the carriage 35 for the second sewing head 22 to provide a visual reference as to the position of the second sewing head with respect to the sewing area and/or first sewing head, such as for the attachment of horizontally or vertically oriented handles.

Each of the carriages further generally can include a guide or control lever 42 having a locking button 43 or similar mechanism for engaging and disengaging a lock or catch mechanism for fixing each of the carriages, and thus the sewing heads 21/22, in a desired position with respect to the sewing area as needed for sewing horizontally or vertically oriented handles. Additionally, sensors (not shown) can monitor the position of the carriages 35 of each of the first and second sewing heads 21 and 22 and provide feedback to the system control 20. Thus, if, for example, the first and second sewing heads are positioned in their first, longitudinally spaced position or arrangement along the sewing area 11, whereby the sewing needle of the second sewing head generally is located downstream from the sewing needle of the first sewing head, such as for attaching the handles into the border in a horizontal orientation, but the system control has been programmed for attaching the handles in a vertical orientation, an alert can be provided to advise the operator to an error or fault condition. The system control also can halt operation of the system 10 until the first and second sewing heads have been moved to their second or laterally spaced position, such as shown in FIG. 4B, wherein the sewing heads are generally located in opposed, or substantially facing relationship on opposite sides of the sewing area to enable sewing of the handles in their vertical orientation with respect to the border.

Figure 4A:
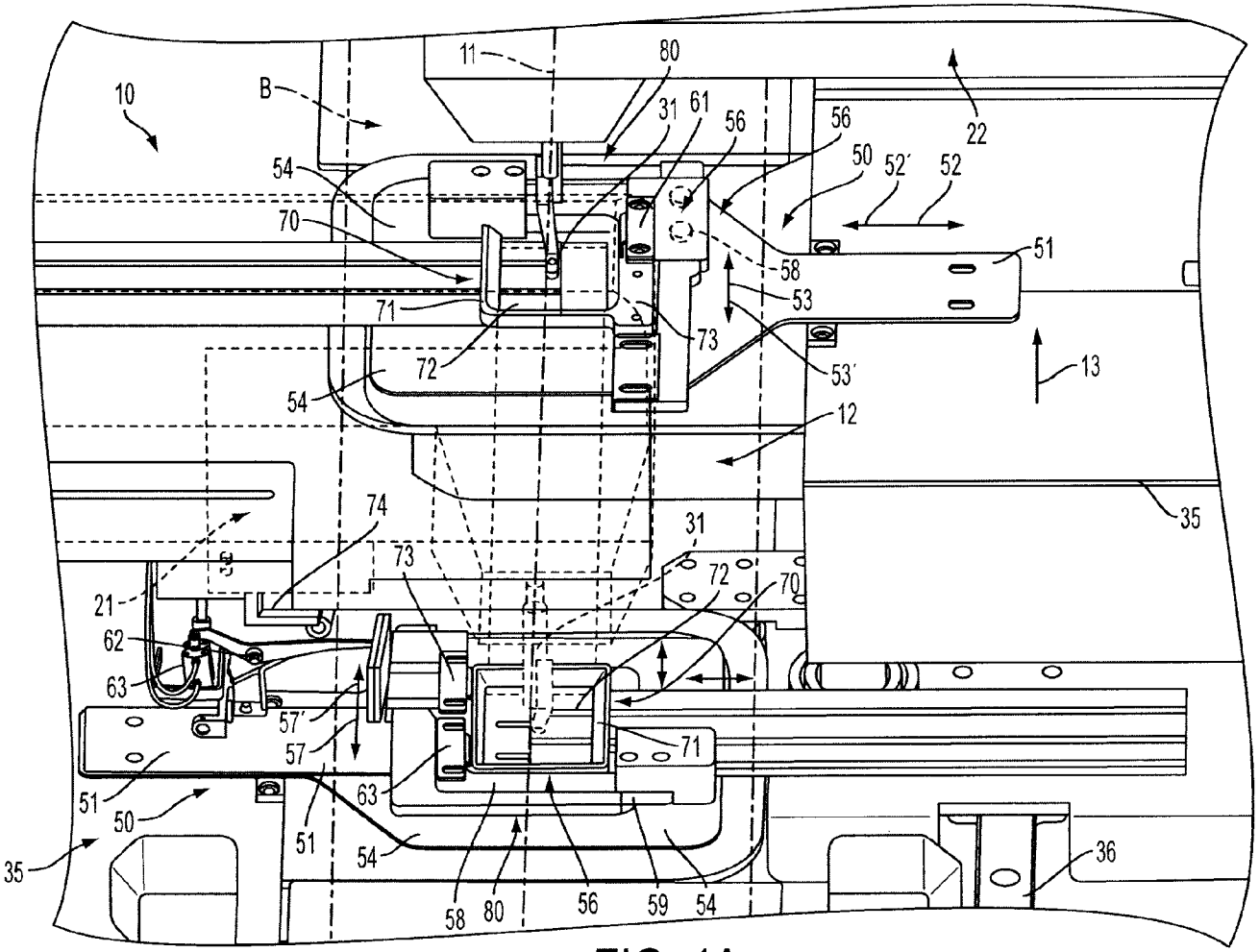
FIG. 4A is a schematic illustration of the sewing area of the system for attaching handles to border materials shown in FIGS. 1-3, with the sewing heads aligned in a staggered position.
Figure 4B:
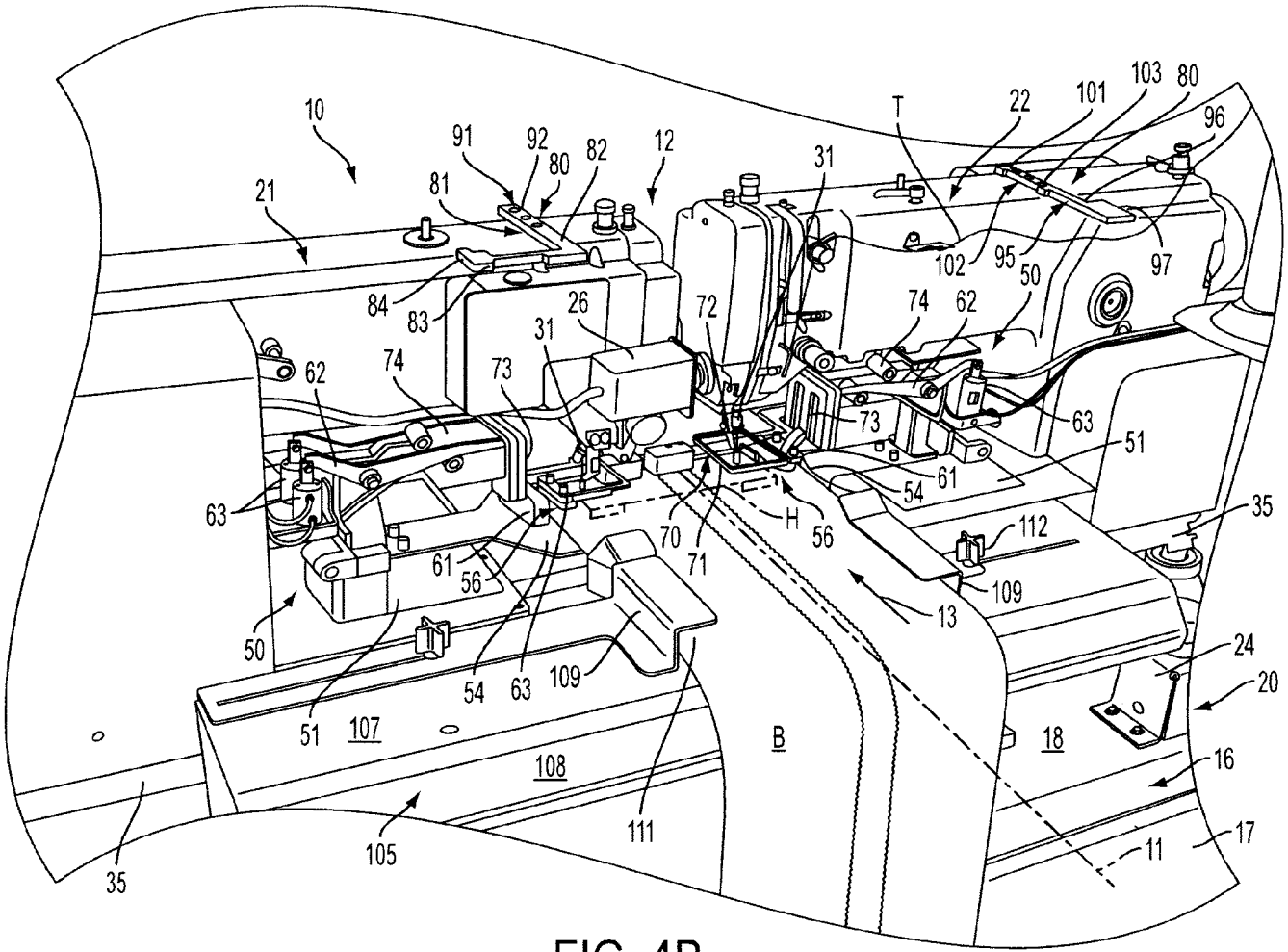
FIG. 4B is a schematic illustration of the sewing area of the system for attaching handles to border materials shown in FIGS. 1-3, with the sewing heads aligned in an aligned position.

As generally illustrated in FIGS. 1 and 4A-4B, each of the sewing heads 21 and 22 further generally includes a clamping mechanism 50 which is operable by engagement of the foot pedal 27 and/or interface 23 of the system control in order to engage and clamp the handles and border together for sewing. Each of the clamping mechanisms 50 will be mounted beneath its respective sewing head 21/22 and generally is mounted on a movable support or clamp support 51. The clamp supports 51 can include an X-Y table so as to facilitate movement of the clamp mechanism, and thus the handle and border clamped thereby, in X and Y directions with respect to the sewing needle 31 of each sewing head, as indicated by arrows 52/52' and 53/53' in FIG. 5. The X-Y tables of the clamp supports 51 generally can be driven by a motor or similar drive mechanism within the frame or cabinet under operation of the system control.

Each clamping mechanism further generally includes a laterally extending lower clamp plate 54 against which the border and handle be engaged during a clamping operation. A first or primary clamp 56 generally is positioned above the clamp plate 54 and is movable between a first, raised position and a second, lowered position, as indicated by arrows 57/57' in FIG. 4A in order to move the first or primary clamp into and out of engagement with the border material B. Each primary clamp 56 generally can include a substantially L or C shaped clamp element or body, typically formed from a metal or similar nonstick or nonskid material, with a locating surface or edge 59 generally formed along at least one side or leg thereof. The body 58 of each primary clamp 56 generally will be connected by a bracket 61 to a pivoting linkage or arm 62 (FIG. 4B) for raising and lowering the primary clamp between its nonengaging and engaging positions. An actuator 63, such as a hydraulic or pneumatic cylinder, solenoid or other actuator will be mounted to an opposite end of the linkage 62 and can be operable in response to engagement of the foot pedal 27 (FIG. 2) by the operator to lower the primary clamp of each sewing head into its clamping position against the border.

Figure 5:
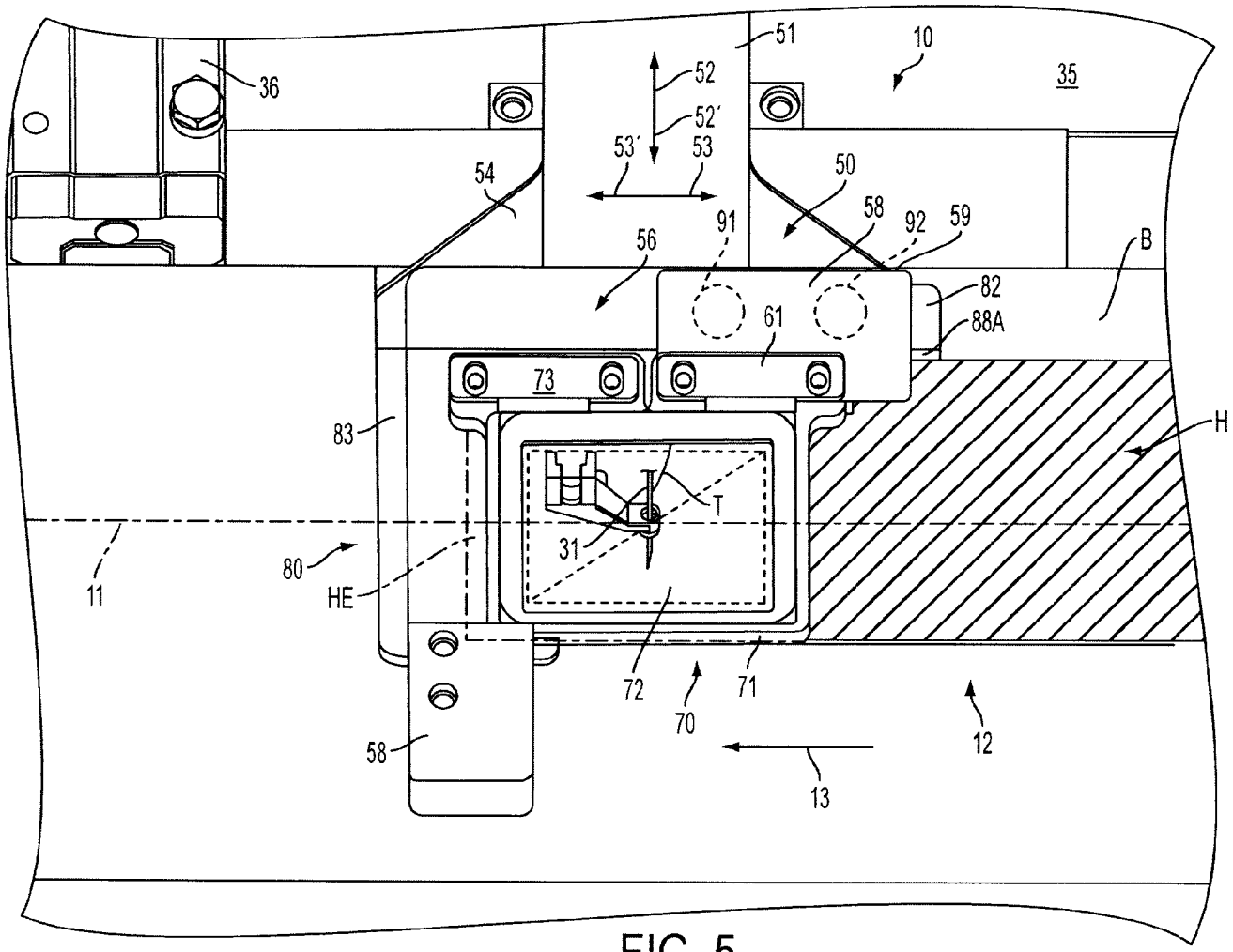
FIG. 5 is a plan view of the clamping mechanism surrounding a sewing needle of one of the sewing heads.

Each of clamping mechanisms 50 also can include a secondary clamp 70, which can include the presser foot of its sewing head 21/22. As shown in FIGS. 4A-4B and 5, each of the secondary clamps 70 generally can include a substantially square or rectangularly shaped body 71, defining an open space 72, in which the sewing needle 31 of its respective sewing head is received. Each secondary clamp generally will be connected via a bracket 73 to a pivoting linkage or arm 74, which can include the presser foot lift linkage of its associated sewing head. Movement of this linkage or arm causes movement of each secondary clamp between an engaged or nonengaging position and a lower, engaging position so as to clamp a portion (i.e., a corner or end—shown in phantom lines HE in FIG. 5) of a handle H against the border B, as shown in FIG. 5, after the border has been engaged and held in a clamped position by the primary clamps 56, for sewing of the handles to the border by the sewing needles of the sewing heads. The actuation of the secondary clamp likewise can be initiated by engagement of the foot pedal of the system control by the operator once the operator has properly positioned the handle along the border in a desired orientation or position along the border as needed for sewing.

As further illustrated in FIGS. 4A and 4B, handle edge guides 80 generally will be releasably mountable to each of the first or primary clamps 56 of each clamping mechanism 50 for the first and second sewing heads 21 and 22. Example embodiments of edge guides 80 are shown in FIGS. 6A and 6B.

Figure 6A:
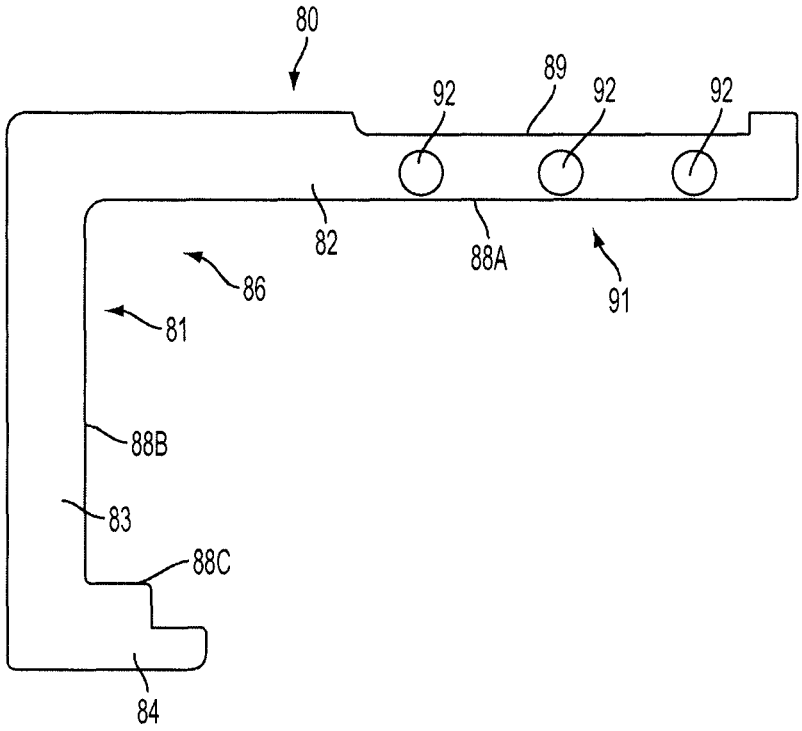
FIGS. 6A-6B are plan views showing example embodiments of the edge guides.

In a first embodiment, illustrated in FIG. 6A, the edge guides 80 can include or comprise substantially L, J or C-shaped bodies 81 here shown with a first elongated leg 82, and a second, shorter leg 83 that extends at approximately a 90° angle with respect to the first leg 82 and terminates in a projection 84, generally shown as extending substantially parallel to the first leg 82. A guide recess or area 86 is thus defined between the first and second legs 82/83 and the projection 84 of the body 81, with corresponding guide surfaces 88A-C generally being formed therealong. The guide recess 86 is adapted to receive a corner or end portion HE (FIG. 5) of a handle therein for substantially precisely locating the handle in a desired or necessary position for attachment to the border. The body 81 of edge guide 80 shown in the embodiment of FIG. 6A further generally will include a locating or engagement surface or edge 89, shown in FIG. 6A as extending along a substantially C-shaped recess. This locating surface 89 is adapted to engage the corresponding mating or locating surface 59 (FIG. 5) of the primary clamp to which the edge guide is mounted for guiding the edge guide into a proper or desired alignment with respect to its primary clamp.

As further illustrated in FIG. 6A, a series of releasable connector elements 91 can be mounted in spaced series along one of the legs, e.g., the first leg 82, of the body 81 of the edge guides 80. In one example embodiment, the releasable connectors 91 can comprise a series of magnetic connectors 92 for connecting the edge guides to the lower surfaces of their corresponding primary clamps of each of the clamping mechanisms. It will also be understood by those skilled in the art that other releasable connectors also can be used. The use of the releasable connectors 91 enables quick detaching/attaching of the edge guides to their primary clamps, and further can help facilitate the location of the edge guides in a proper position along their respective primary clamps. For example, the use of the magnetic connectors 92, in conjunction with the engagement between the locating surfaces of each of the edge guides and their respective primary clamps to which they are engaged can perform a substantially self-locating or aligning function whereby the edge guides will be easily brought into registration with their primary clamps without requiring substantial disassembly or other operations to mount the edge guides to the clamping mechanisms.

Figure 6B:
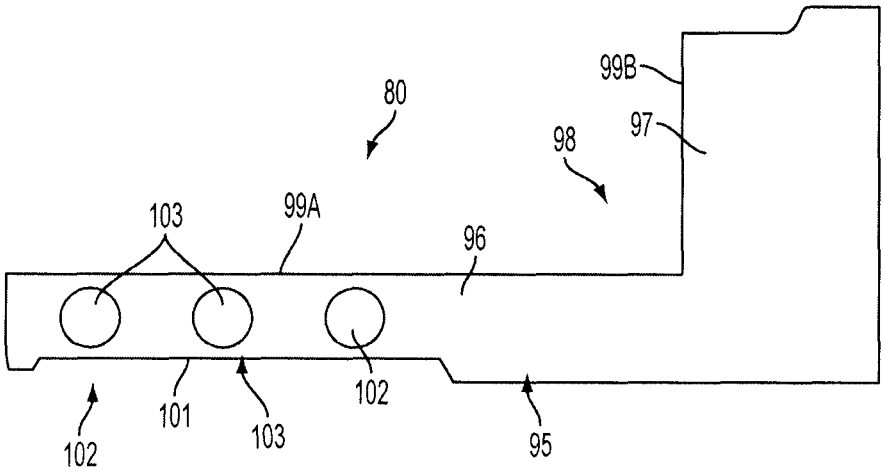

FIG. 6B illustrates a further alternative embodiment of the edge guides 80, generally including a substantially L-shaped body 95. In this embodiment, the body 95 of the edge guide generally will include a first leg 96 and a second leg 97 extending at an angle, here shown as approximately 90°, although other angles also can be used, with respect to the first leg 96. The legs 96 and 97 define a guide recess 98 having guide surfaces 99A and 99B formed along the first and second legs 96 and 97 of the body 95. An end or corner of the handle can be received within the guide recess 98 with side edges thereof being engaged against the guide surfaces 99A and 99B for locating the corner end of the handle in a desired location for sewing. The body 95 of the present embodiment of an edge guide 80 further can include a corresponding locating surface 101, that is adapted to engage and mate with the locating surface of a primary clamp of one of the clamping mechanisms, and further will generally include a series of releasable connectors 102, such as magnetic connectors 103 or other, similar releasable connectors.

It will also be understood that the edge guides 80 shown in FIGS. 6A and 6B further can be formed in other, varying configurations and sizes in order to accommodate different configuration or size handles. In addition, the edge guides can be selected based upon the desired orientation in which the handle is to be attached. For example, edge guides as shown in FIG. 6A can be utilized for positioning or locating the ends of the handles in a desired horizontal orientation or position for attaching the handles in a horizontal alignment with respect to the longitudinal axis or length of the border, while the edge guides shown in FIG. 6B can be used for attachment of the handles in a vertical orientation with respect to the longitudinal length or axis of the border. The edge guides further can be located or positioned in different orientations along their respective or corresponding primary clamps as needed to help facilitate attachment of the handles in the desired orientation.

In addition, as illustrated in FIGS. 1-3 and 4B, a material guide 105 can be mounted along the upstream edge of the frame or cabinet 16, generally in front of the sewing area 12 of the system 10. The material guide 105 generally will include an elongated plate 106 typically made from a metal such as steel or other non-stick, non-skid material and will have an upper guide surface 107 over which the border B is passed. The front edge 108 of the plate 106 further can be beveled or oriented at an angle to help guide the border onto and over the upper surface of the guide plate 106. As additionally illustrated in FIGS. 1 and 4B, side edge guides 109 will be mounted along the guide plate 106, with one or both of the side edge guides generally being moveable with respect to the other side edge guide in order to define a passage or guide area 111 through which the border is directed as the border is fed along its path of travel 13 into the sewing area 12. Each of the side edge guides 109 can include a substantially L or C-shaped plate that is slidably moveable along the upper surface 107 of the material guide plate 106 and can be fixed in place by a set screw 112 or similar locking mechanism.

As generally illustrated in FIG. 3, a downstream material guide 115 can be mounted adjacent the downstream or second sewing head 22. The downstream material guide typically will have a construction similar to the upstream material guide, including an elongated plate 116 having an upper surface 117 and one or more movable side edge guides 118. The downstream material edge guide will receive the border material therethrough after sewing for guiding the sewn border, with handles attached thereto, away from the system 10 for collection, such as on a supply roll or other collection means.

In operation of the system 10 for attaching handles H to a length of border material B, as indicated in FIGS. 1-3, the operator generally will adjust the position of the first and second sewing heads 21 and 22 along the sewing area 12 as needed for sewing the handles in either a substantially horizontal orientation extending along the lengthwise direction of the border, or for attachment of the handles in a substantially vertical orientation, extending widthwise or along the height of the border. For example, if the handles are to be attached to the border in a horizontal orientation, the first and second sewing heads can be moved to a first position wherein the sewing needles of the sewing heads are longitudinally spaced along the sewing area 12, as illustrated in FIGS. 2-3. To move the sewing heads into this first position, the first or left-hand sewing head 21 can be moved laterally, while the second or right-hand side sewing head 22 can be moved longitudinally to place the sewing heads in a desired alignment and at a desired spacing for attaching a handle of a selected size and/or configuration to the border. In addition, the operator can further select and apply an edge guide generally corresponding to the shape or size/configuration of the handle to the clamping mechanisms 50 of the respective sewing heads.

Thereafter, the operator typically will feed a length of the border material B over the upstream material guide and through the sewing area 12, with a desired length or amount of the border material being extended through the sewing area as needed to locate the area for placement of a handle thereon between the sewing heads. Once the border has been properly positioned, the operator can engage the foot pedal 27 (FIG. 1) of the system control 20 to engage the primary clamps of the first and second sewing heads 21/22. The primary clamps will clamp the border in place, after which the operator can then place the handle on the border, with at least one of the ends of the handle being placed against at least one of the edge guides attached to one of the primary clamps of the first and second sewing heads to locate or position the handle as needed for sewing it to the border. With the handle thus positioned along the border, the operator thereafter will engage the foot pedal of the system control a second time, whereupon the secondary clamps of each of the sewing heads will move into engagement to clamp the ends of the handle against the border and initiate a sewing operation.

The handle then can be substantially automatically sewn to the border by reciprocation of the sewing needles of the sewing heads into and out of the handle and border. The clamping mechanisms of each of the sewing heads can be moved in an X-Y fashion with respect to the sewing needles of the sewing heads such that the handle and border will be moved beneath the sewing needles as the sewing needles are reciprocated in order to form lines of stitching therein for attachment of the ends of the handle to the border. The respective clamping mechanisms of the first and second sewing heads generally will be moved in a substantially mirror or cooperative fashion for sewing or attachment of the handle ends to the border while the sewing heads themselves generally can remain in a substantially stationary position. After the ends of the handle have been sewn to the border, the system control will stop the sewing, cut the threads and release the border and handle from their clamped engagement. The operator can then continue feeding of the border through the sewing area, for example, by hand, or by engaging an automated feeder mechanism (not shown) to pull a desired amount of the border through the sewing area to a position for application of a next handle to the border.

In order to sew a handle in a different orientation, i.e., to sew a vertically oriented handle as opposed to a horizontally oriented handle, the operator will again adjust the positions of the first and second sewing heads with respect to each other so as to move the first and second sewing heads into a second position located substantially laterally spaced across the sewing area. For example, the first or left-hand sewing head can be moved laterally away from the sewing area into a desired position along its guide rule, while the second or right-hand sewing head can be moved forwardly into a position substantially aligned with and/or facing opposite the first sewing head, with the sewing needles of the sewing heads being separated across the sewing area by a desired spacing as needed to accommodate a selected size or length handle. In addition, the operator can replace or change out the edge guides attached to each of the primary clamps as needed to accommodate the different orientation and/or size handle. Thereafter, the sewing operation can be initiated as discussed above, with the border material being initially clamped in place after which the handle can be positioned along the border material and engaged by the secondary clamp of each sewing head, and a sewing operation commenced.

The foregoing description generally illustrates and describes various embodiments of the present invention. It will, however, be understood by those skilled in the art that various changes and modifications can be made to the above-discussed construction of the present invention without departing from the spirit and scope of the invention as disclosed herein, and that it is intended that all matter contained in the above description or shown in the accompanying drawings shall be interpreted as being illustrative, and not to be taken in a limiting sense. Furthermore, the scope of the present disclosure shall be construed to cover various modifications, combinations, additions, alterations, etc., above and to the above-described embodiments, which shall be considered to be within the scope of the present invention. Accordingly, various features and characteristics of the present invention as discussed herein may be selectively interchanged and applied to other illustrated and non-illustrated embodiments of the invention, and numerous variations, modifications, and additions further can be made thereto without departing from the spirit and scope of the present invention as set forth in the appended claims.

The invention claimed is:

1. A system for applying a handle to a workpiece, comprising:

a work surface defining a sewing area at which the handle is applied to the workpiece;

a first sewing head located along said sewing area, said first sewing head including at least one sewing needle, and a clamping mechanism for engaging and clamping the workpiece and a portion of the handle in a desired position for sewing the handle to the workpiece; and a second sewing head located along said sewing area adjacent said first sewing head, said second sewing head including at least one sewing needle and a clamping mechanism for engaging and clamping the workpiece and a portion of the handle in a desired position for sewing the handle to the workpiece;

wherein at least one of said first and second sewing heads is adjustably mounted along said sewing area so as to enable movement between a first position whereby said first and second sewing heads are arranged in a longitudinally spaced alignment along said sewing area, and a second position whereby said first and second sewing heads are arranged in a laterally spaced alignment for attachment of the handles to the workpiece with the handle positioned in different selected orientations on the workpiece.

2. A system for applying a handle to a workpiece, comprising:

a work surface defining a sewing area at which the handle is applied to the workpiece;

a first sewing head located along said sewing area, said first sewing head including at least one sewing needle, and a clamping mechanism for engaging and clamping the workpiece and a portion of the handle in a desired position for sewing the handle to the workpiece; and a second sewing head located along said sewing area adjacent said first sewing head, said second sewing head including at least one sewing needle and a clamping mechanism for engaging and clamping the workpiece and a portion of the handle in a desired position for sewing the handle to the workpiece; and edge guides releasably mounted to said clamping mechanisms of said first and second sewing heads;

wherein at least one of said first and second sewing heads is adjustably mounted along said sewing area so as to enable movement between a first position whereby said first and second sewing heads are arranged in a longitudinally spaced alignment along said sewing area and a second position whereby said first and second sewing heads are arranged in a laterally spaced alignment for attachment of the handles to the workpiece with the handle positioned in different selected orientations on the workpiece.

3. The system of claim 2, wherein said edge guides can be selected from a series of edge guides having varying configurations to match different handle configurations and/or different orientations of the handle with respect to a longitudinal length of the workpiece.

4. The system of claim 2, wherein said edge guides each comprise an elongated plate having a series of magnetic connectors mounted therealong for releasably attaching said edge guides to said clamping mechanisms of said first and second sewing heads.

5. A system for applying a handle to a workpiece, comprising:

a work surface defining a sewing area at which the handle is applied to the workpiece;

a first sewing head located along said sewing area, said first sewing head including at least one sewing needle, and a clamping mechanism for engaging and clamping the workpiece and a portion of the handle in a desired position for sewing the handle to the workpiece; and a second sewing head located along said sewing area adjacent said first sewing head, said second sewing head including at least one sewing needle and a clamping mechanism for engaging and clamping the workpiece and a portion of the handle in a desired position for sewing the handle to the workpiece;

wherein at least one of said first and second sewing heads is adjustably mounted along said sewing area so as to enable movement between a first position whereby said first and second sewing heads are arranged in a longitudinally spaced alignment along said sewing area, and a second position whereby said first and second sewing heads are arranged in a laterally spaced alignment for attachment of the handles to the workpiece with the handle positioned in different selected orientations on the workpiece; and wherein said clamping mechanisms of said first and second sewing heads each comprise a primary clamp adapted to engage and hold the workpiece, and a secondary clamp for engaging and holding the handle against the workpiece for sewing.

6. The system of claim 5, further comprising edge guides mounted to said primary clamps and each comprising an elongated plate defining a guide surface along which a side edge of the handle is placed to locate the handle in a desired position for sewing to the workpiece, and at least one releasable connector mounted therealong for releasably attaching said edge guides to said primary clamps.

7. The system of claim 1, wherein said first sewing head is mounted on a first movable carriage so as to be adjusted laterally with respect to said sewing area; and wherein said second head is mounted on a second movable carriage so as to be adjustable longitudinally with respect to said sewing area.

8. A system for applying a handle to a workpiece, comprising:

a work surface defining a sewing area at which the handle is applied to the workpiece;

a first sewing head located along said sewing area, said first sewing head including at least one sewing needle, and a clamping mechanism for engaging and clamping the workpiece and a portion of the handle in a desired position for sewing the handle to the workpiece; and a second sewing head located along said sewing area adjacent said first sewing head, said second sewing head including at least one sewing needle and a clamping mechanism for engaging and clamping the workpiece and a portion of the handle in a desired position for sewing the handle to the workpiece;

wherein at least one of said first and second sewing heads is adjustably mounted along said sewing area so as to enable movement between a first position whereby said first and second sewing heads are arranged in a longitudinally spaced alignment along said sewing area, and a second position whereby said first and second sewing heads are arranged in a laterally spaced alignment for attachment of the handles to the workpiece with the handle positioned in different selected orientations on the workpiece; and wherein each of said clamping mechanisms of said first and second sewing heads comprises a clamp body having at least one locating surface for locating and mounting an associated edge guide thereto.

9. The system of claim 1, further comprising a workpiece guide upstream from said sewing area for guiding the workpiece into said sewing area.

10. The system of claim 1, wherein each clamping mechanism of each of said first and second sewing heads comprises a movable clamp support, and wherein said clamp supports of said clamping mechanisms of said first and second sewing heads are moved together in a mirrored movement so as to move the handle and workpiece with respect to the sewing needles of the first and second sewing heads.

11. A method of attaching a handle to a border, comprising:

adjusting a lateral position of a first sewing head and a longitudinal position of a second sewing head along a sewing area to place the first and second sewing heads in an alignment for sewing the handle in a selected approximately vertical or horizontal orientation with respect to a longitudinal axis of the border;

feeding a length of border material into a sewing area;

engaging the border with a clamp associated with the first sewing head;

engaging the border with a clamp associated with the second sewing head;

aligning an edge of the handle with at least one edge guide positioned adjacent the clamp associated with the first or second sewing head to locate the handle in a desired position along the border; and engaging and sewing of the handle to the border with the first and second sewing heads.

12. The method of claim 11, wherein engaging and sewing of the handle to the border comprises engaging the handle with secondary clamps associated with each of the first and second sewing heads, reciprocating sewing needles of the first and second sewing heads into and out of the handle and border material to form stitches therein, and moving the clamped handle and border material in X and Y directions with respect to the sewing needles of the first and second sewing heads to attach the handle to the border material.

13. The method of claim 11, further comprising selecting at least one edge guide having a configuration substantially matching a configuration and/or orientation of a portion of the handle, and releasably mounting the selected edge guide along the clamp of the first or second sewing head.

14. The method of claim 13, further comprising disengaging the selected edge guide from the clamp, selecting a second edge guide of a differing configuration as needed for attaching a handle having a different configuration or orientation, and releasably attaching the secondary edge guide to the clamp.

15. The method of claim 11, wherein feeding the length of border material comprises passing the border material through an adjustable guide for guiding the border material into the sewing area.

* * * * *